United States Patent [19]

Baker et al.

[11] 4,085,171

[45] Apr. 18, 1978

[54] SPRAY COOLING SYSTEM

[75] Inventors: Donald B. Baker, Foxboro; William E. Sparko, Westwood, both of Mass.

[73] Assignee: Bird Machine Company, Inc., South Walpole, Mass.

[21] Appl. No.: 797,699

[22] Filed: May 17, 1977

Related U.S. Application Data

[63] Continuation-in-part of Ser. No. 643,337, Dec. 22, 1975, abandoned.

[51] Int. Cl.[2] ..... B01F 3/04; B05B 1/04

[52] U.S. Cl. ..... 261/36 R; 239/498; 239/543; 239/550; 239/557; 261/116; 261/119 R; 261/DIG. 75; 261/DIG. 79

[58] Field of Search ..... 239/543, 544, 559, 557, 239/498, 550, 558; 261/116, DIG. 75, 119 R, 115, 36 R, DIG. 79

[56] References Cited

U.S. PATENT DOCUMENTS

| | | | |
|---|---|---|---|
| Re. 27,853 | 12/1973 | Frohwerk | 239/550 |
| 612,433 | 10/1898 | Orford | 239/498 |
| 924,500 | 6/1909 | Rush | 239/544 |
| 1,164,128 | 12/1915 | Sexton | 239/544 |
| 1,233,119 | 7/1917 | Parker | 261/119 R |
| 1,658,533 | 2/1928 | Mart | 261/116 |
| 1,896,202 | 2/1933 | Richardson | 239/543 |
| 1,957,862 | 5/1934 | Taylor | 239/543 |
| 2,017,338 | 10/1935 | Brown | 239/543 |
| 2,564,060 | 8/1951 | Gettins | 261/116 |
| 2,566,392 | 9/1951 | Wilkins et al. | 239/543 |
| 2,754,151 | 7/1956 | Williamson | 239/543 |
| 3,030,031 | 4/1962 | Barker | 239/543 |
| 3,044,754 | 7/1962 | Skerkoske et al. | 239/559 |
| 3,125,298 | 3/1964 | Iwata | 239/543 |
| 3,270,966 | 9/1966 | Ackley | 239/550 |
| 3,406,913 | 10/1968 | Frangos | 239/543 |

FOREIGN PATENT DOCUMENTS

| | | | |
|---|---|---|---|
| 1,245,635 | 10/1960 | France | 239/543 |

*Primary Examiner*—Tim R. Miles
*Attorney, Agent, or Firm*—Edgar H. Kent

[57] ABSTRACT

A system for spray cooling large quantities of heated water has a plurality of spray forming means each consisting of a plurality of associated nozzles connected by piping to pumps, each of the associated nozzles having an outlet constructed and arranged to discharge the water in a coherent stream which impinges upon the stream ejected by each other associated nozzle in a common zone beyond the nozzle with a force which breaks the streams into a spray of drops having a resultant trajectory away from the nozzles into a receiver. The water may be aerated before discharge from the nozzles, this being effectively accomplished by means of air inlets to a venturi passage in each nozzle.

19 Claims, 15 Drawing Figures

FIG 4
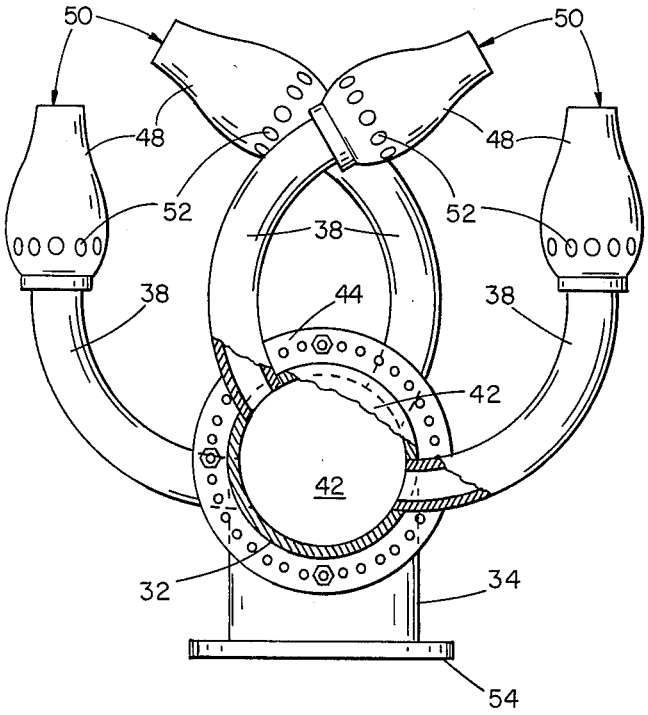
FIG 5
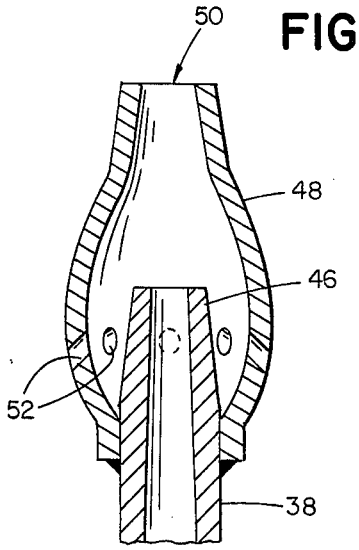
FIG 6
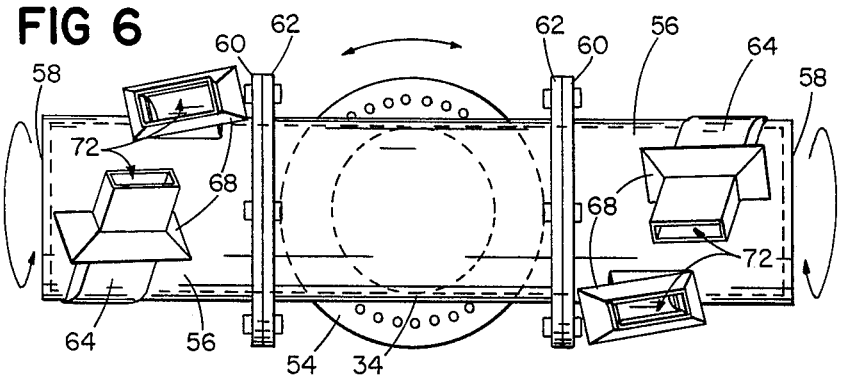
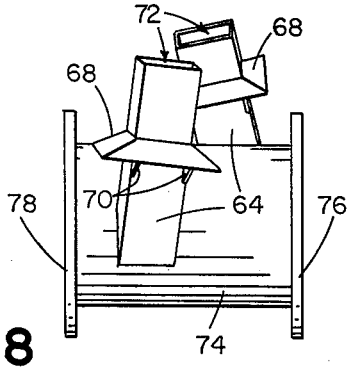
FIG 8
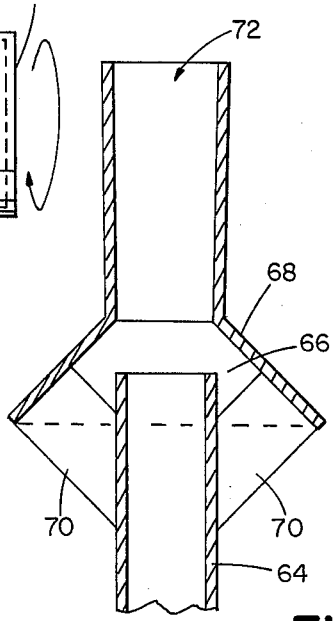
FIG 7

SPRAY COOLING SYSTEM

CROSS-REFERENCE TO RELATED APPLICATION

This application is a continuation-in-part of our U.S. patent application Ser. No. 643,337, filed Dec. 22, 1975, now abandoned.

BACKGROUND OF THE INVENTION

1. Field of the Invention

This invention relates to spray cooling systems for cooling large volumes of heated water.

2. Description of the Prior Art

The pressure on industry to avoid thermal pollution by the discharge of heated plant water to river, lake or ocean has drastically increased the demand for efficient, large capacity water cooling systems. Such systems, for example, may be required to cool from 400,000 to 1,000,000 or more gallons per minute of heated water discharged from the cooling systems of power plants sufficiently to enable its discharge without damage to the ecology or its recycling to the plant cooling system. Typical spray cooling systems pump the heated water from a channel, in which it flows for discharge or recycling to nozzles mounted on fixed structures or floats, which spray it back to the channel. Many such nozzles are needed, of large capacity of 500 to several thousand gallons per minute or more.

Such spray cooling systems as heretofore provided have had certain deficiencies which have led to a general dissatisfaction with this type of system for the purpose. One major deficiency has been too low a cooling efficiency in relation to capital and power costs. Another such deficiency has been the development of excessive mist which, under wind-drift conditions, can become a public nuisance, and is also a loss to the cooling system, reducing cooling efficiency. It has been ascertained that a primary cause of these deficiencies has been the failure of the prior art to provide suitable spray forming equipment in such systems.

In particular, the spray nozzles in general use for the purpose are of a type that generates a conical spray surrounding the nozzle which expands outwardly as it rises and then falls more or less vertically into the receiver. Since the nozzle is located close to the surface, the sheet-like spray forms a double curtain wall surrounding the nozzle which effectively blocks access of fresh, unsaturated air to the undersurface of the spray, that is, the inside surface of the curtain walls of spray, and, to a somewhat lesser extent, to the inner upper surface of the spray. Thus, effective cooling of the sprayed water by convection to and evaporation into the air is largely confined to the outer surface of the spray. In addition, existent designs of such nozzles tend to form a far from uniform spray, with a substantial proportion of oversize drops (1 inch or more in diameter). Further, such nozzles can be used only where surrounded by the receiver, and are not suitable for mounting on land at the side of the receiver, as may be desirable.

SUMMARY OF THE INVENTION

Accordingly, it is a general object of this invention to improve the efficiency of spray cooling systems of the type concerned.

Another object of the invention is to provide, in such improved spray cooling systems, nozzles for producing spray having greater cooling efficiency. Another object is to include means for aerating the water prior to ejection from such nozzles to increase the cooling efficiency of the spray produced thereby.

A further object of the invention is to provide, in such improved spray cooling systems, nozzle means with which the spray can be controlled to regulate drop size and to avoid excessive misting, while still obtaining the foregoing objectives. Yet another object is to attain the foregoing objectives without increasing the cost of the equipment required.

We have discovered that a spray of greater cooling efficiency than that heretofore obtained in such spray cooling systems is produced as the resultant of the impact of coherent streams of the heated water from a plurality of nozzles, preferably two, impinging shortly after ejection from the nozzles in a common zone before the stream has dissociated. By properly correlating stream size and shape, flow rate and angle of stream impact, it has been found that the kinetic energy at impact breaks the resultant stream into a spray of droplets of a desired size and substantial uniformity. The resultant spray is an open-ended arch that fans out laterally from the point of formation.

The preferred nozzle shape is circular in cross-section, but where the desired flow would require a very large circular outlet, for example, exceeding 4 inches in diameter, an elongated rectangle or oval shape may be preferred. The cross-sectional area of the outlet and of the resultant ejected stream is at least two square inches, with a minimum cross-sectional dimension of 1 inch. The streams are ejected in a more or less straight (non-divergent) path, a fan-shaped stream of wide angle being undesirable, and desirably intersect at a distance of about 3 to 18 inches from the nozzle outlet, before they have significantly dissociated. The nozzles are mounted and directed such that the resultant spray follows a trajectory proceeding away from the source at an angle between vertical and horizontal so that there is substantially no backfall of spray into subsequently formed spray. The intersecting streams have preferably about the same volume, with their combined volume from 500 to 5000 or more gallons per minute. The streams should be discharged at a pressure head, for example of 12 to 13 feet, adequate to produce a resultant spray trajectory of sufficient length, this being desirably at least 20 feet, preferably 40 feet or longer, spreading into fan shape as it travels.

The cooling effectiveness or heat transfer efficiency of warm water spray is dependent on a number of factors, such as the air wet and dry bulb temperature, initial water temperature, drop size, initial velocity and residence time in the air, the last three factors being important controllable variables. Under given other conditions, cooling efficiency is inversely proportional to drop size and directly proportional to air residence time.

With our improved system, drop size can be varied and controlled more effectively than in systems of the prior art, since it appears to be in general inversely proportional to the size of the angle of impingement of the streams at a given velocity at impact. In our system it has been found that two streams moving at a velocity of about 30 feet per second and impinging at an included angle of about 70° for round cross-section nozzles or about 50° for the other shapes, break up with great uniformity into drops of about 0.4–0.5 inch diameter, the desired size range. With such drop size and a trajectory providing an air residence time of about 2 seconds, our spray was found to have substantially greater cooling efficiency than spays from prior art nozzles tested under the same conditions, and also than reported cooling efficiencies of systems in commercial use.

Preferably, the associated nozzles are arranged so that the axes of their outlets and the streams ejected thereby intersect at an included angle between about 60° and 80° for round cross-section nozzles and 40° to 60° for the other shapes. At higher angles, the reduced air residence time of the smaller sized drops (e.g., 0.25 inch or less) plus a much greater tendency to produce micro drops or mist make the larger size drops predominant in the preferred angle range generally more desirable. Included angles larger than the preferred range also have a tendency toward excessive backfall. On the other hand, included angles smaller than the preferred range tend to produce a drop size range larger than desired for efficient cooling, including large slugs of water.

The velocity of the streams at impact should be sufficient to insure thorough penetration of the streams into one another and such that they break into a spray of drops having the desired trajectory rather than forming large slugs of water that fall back or follow a short path as occurs with inadequate velocities. It has been found that impact velocities in the range 25 to 35 feet per second are generally suitable and that higher velocities with their higher power costs are not needed.

We have also discovered that the greater comparable cooling efficiency of spray produced by our nozzle system is still further increased by aerating the water before it is ejected from the nozzles. This is preferably accomplished by causing the streams to suck air into their bodies as they flow with a venturi action past air inlet ports in the nozzle bodies upstream of their outlets, preferably to the extent of at least one volume of air to four volumes of water. By inducting air into the water in this manner, the cooling efficiency of our sprays was increased substantially, by 30% or more, depending on weather conditions. Compressed air injected into the water upstream of the nozzles produced a similar but no greater effect, hence air induction at the nozzles at no cost is preferred. However, total efficiency of the system in terms of horsepower requirements for given cooling may not be improved at least to a comparable degree, due to pressure head losses occasioned by the addition of air.

The nozzles may be made adjustable to vary the angle of impingement of the streams. However, since this involves increased complexity and cost, it is preferred to provide interchangeable short pipe sections having nozzles of different fixed angular relations. These pipe sections are equipped with flanges by which they may be connected to adjoining pipe with the nozzles at different angular positions about the axis of the pipe as may be desired.

The improved cooling efficiency of the nozzles, as compared with those of the prior art discussed above, is attributable in part to the greater access of fresh air to all parts of the spray. This advantage can be enhanced by suitable arrangements of the nozzle sprays with respect to one another. The sprays tend to generate air currents flowing generally parallel to them and in the same direction. By arranging a number of the nozzles so that their sprays are directed toward one another or toward a common center, this air current effect is utilized to promote continual replacement with fresh air of the heated, moisture-laden air between them, which rises in a column with a suction effect, promoting the continual flow of fresh air toward the space between the sprays.

BRIEF DESCRIPTION OF THE DRAWINGS

In the drawings:

FIG. 4 is a view on a larger scale, partly in cross-section, partly in side elevation, of a T-shaped pipe section with two nozzle pairs as in the prior Figures but with the nozzles equipped for air induction;

FIG. 5 is a partial longitudinal section view of one of the nozzles of FIG. 4;

FIG. 6 is a top plan view of a T-shaped pipe section similar to FIG. 4 but having nozzles of a modified form;

FIG. 7 is a partial longitudinal section view through a nozzle of FIG. 6;

FIG. 8 is a perspective view of a pair of nozzles according to FIG. 6 mounted on a different type of pipe section;

DESCRIPTION OF THE PREFERRED EMBODIMENTS

Figure 1:
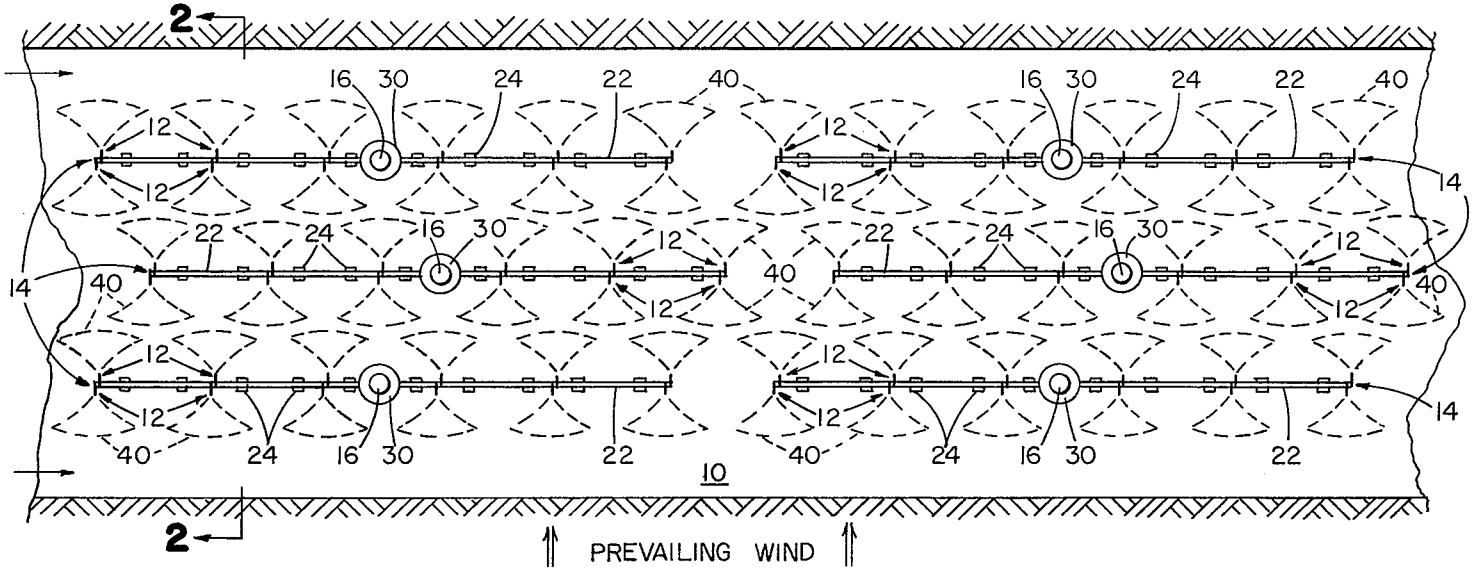
FIG. 1 is a diagrammatic plan view of a portion of a heated water flow channel equipped with a spray cooling system according to the invention.

FIG. 1 shows part of a typical installation of a spray cooling system along a flow channel 10 for heated water, such as may be discharged from the cooling system of a power plant. The channel is assumed to be about 100 feet wide by 15 feet deep with a somewhat less water depth, controlled by a weir (not shown).

As shown, nozzle pairs according to the invention, designated generally 12, are provided in units or modules, designated generally 14, each having 12 nozzle pairs 12 and a pump, designated generally 16. The pumps 16 are mounted on standpipes 18 (FIG. 3) supported on concrete supports 20 on the channel bottom and having a T-connection at the bottom to piping 22 extending from opposite sides of the standpipes longitudinally of the channel bottom and supported on concrete supports 24. Standpipes 18 are provided with inlets 26 for water from the stream and pumps 16 have impellers 28 extending below these inlets to pump the water therefrom downwardly into piping 22. An anti-vortexing plate 30 surrounds the standpipe 18 at the stream surface to inhibit vortexing of the water about the standpipe and provide a steady flow to the inlets.

Figure 2:
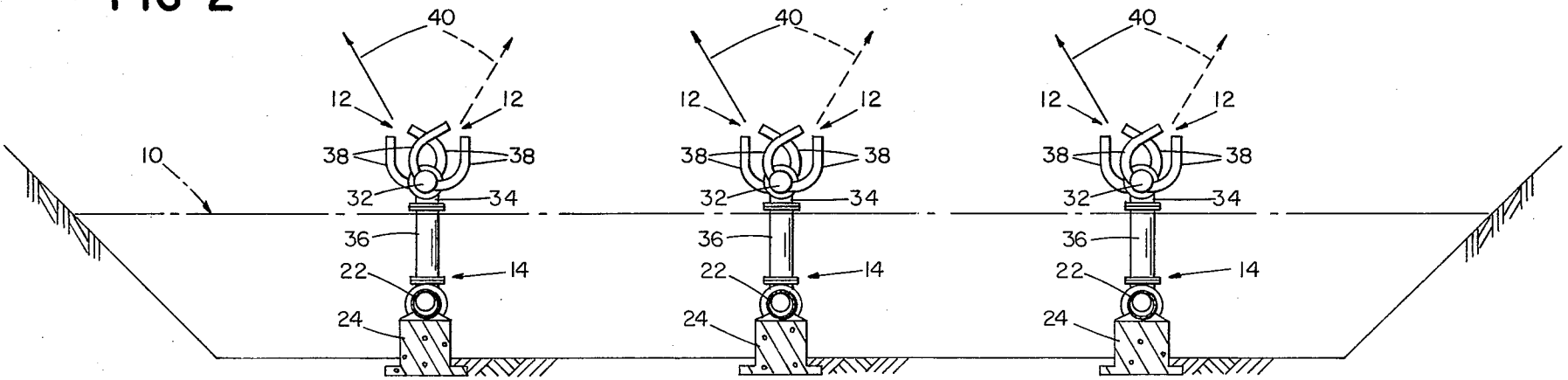
FIG. 2 is a transverse section view on lines 2—2 of FIG. 1, looking in the direction of the arrows.

Nozzle pairs 12 (FIGS. 2 and 3) are mounted on and communicate with the interior of pipe sections 32, having one end closed and the other end bolted to a T-fitting 34 at the top of standpipes 36 connected to piping 22, so that the axes of pipe sections 32 extend longitudinally of the channel, there being two pipe sections 32 and nozzle pairs 12 connected to each of six standpipes 36 in a module 14. Each nozzle of a pair 12 is in the form of a pipe 38 which curves from its inlet end communicating with the interior of pipe section 32, to a substantially straight section terminating in an outlet. Without aeration at the nozzle pipes 38 may be of uniform cross-section throughout, as indicated in FIG. 2. As shown in FIG. 2, the nozzles 38 of each pair are of round cross-section though they may be of other shape, they are connected to the pipe section 32 at opposite sides of its axis, and their outlet ends are at equal opposite angles of about 35° to the axis of pipe section 32. The streams therefrom impinge upon one another at an included angle of about 70°, so that the resultant spray, indicated by the arrowed lines 40 in FIG. 2, is at an angle of about 35° to the axis of each nozzle outlet. Pipe sections 32 are connected to fittings 34 with the nozzles 38 so disposed that the spray resultant from impingement is at an angle to vertical such that the spray follows a desired trajectory away from its source. In a calm area, this angle may preferably be about 45°. Where the spray is into a prevailing wind, the angle to the horizontal is desirably lower to maintain a similar average trajectory and may be as low as 20°. The two sections 32 are connected to the fitting 34 so that the sprays from each nozzle pair are directed to opposite sides of the axis of sections 32, producing the spray pattern of FIG. 1.

As shown, most of each module 14 is submerged, except for the pump motor and the nozzle pairs, sections 32 and fittings 34, and such arrangement is desirable, as a water environment is less corrosive to the metal used in the system than a spray and air environment, particularly where salt water is used, and the weight to be supported under water is much less than in air. The arrangement of nozzle pairs 12 to direct the sprays to opposite sides of the long axes of the modules into and against the prevailing wind as shown in FIG. 1 is a desirable one for good air circulation through the sprays. In this connection, as has been noted above the flat, arched, fan-shaped sprays produced by the nozzle pairs according to this invention permit much better air circulation than can be obtained with the circular or conical sprays which have been predominantly used in the prior art. However, it should be understood that the arrangement shown in FIG. 1, including the number of nozzles per module, their direction and the manner of module support (which may be on floats or on land), are illustrative only and various other arrangements are suitable, as hereinafter further discussed.

Piping 22 between the pump 16 and the first nozzle pairs 12 at either side of it may, for example, be 24 inches in diameter. Beyond each standpipe 36 the diameter of the piping 22 may be reduced to equalize the pressure on further nozzle pairs from the pump.

Figure 3:
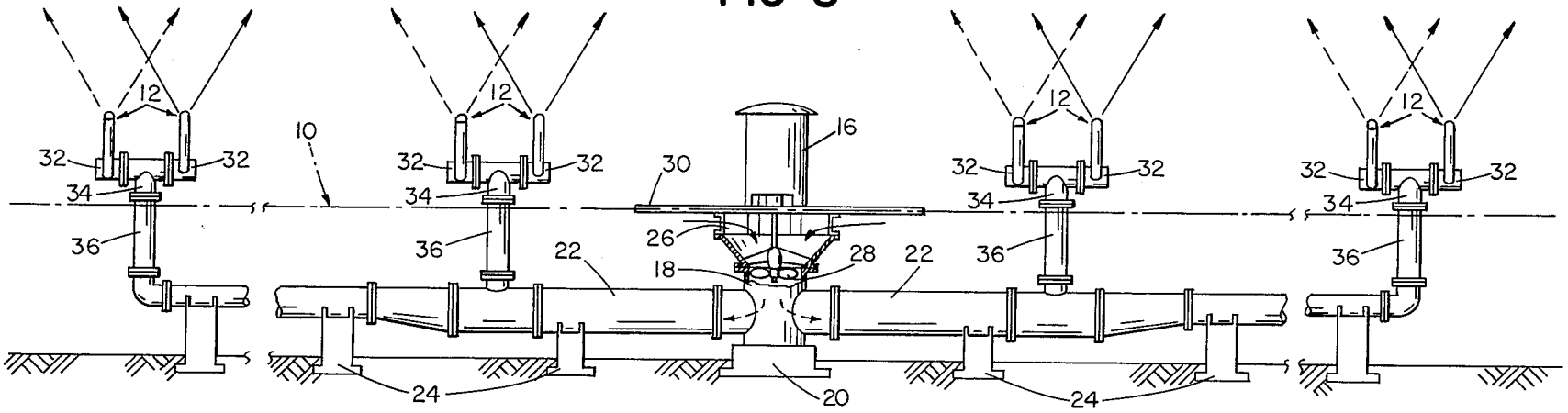
FIG. 3 is a side elevation view, partially broken away, of one of the modules of FIG. 1.

FIGS. 4 and 5 show a circular cross-section nozzle pair as in FIGS. 2 and 3, designed for air induction. The pipe sections 32 are the same as in FIGS. 2 and 3 and have one end closure plate 42 and at the other end an attachment flange 44 for bolting to a corresponding flange on fitting 34, the flanges provided with numerous bolt holes to enable numerous adjustment positions of the nozzle pair about the axis of sections 32. The nozzle pipes 38 are modified to the extent that their outer tips 46 (FIG. 5) are reduced or tapered in external and internal cross-section. A nozzle cap 48, welded at one end around the pipe tip 46, has a bulbous portion surrounding the tip 46 which tapers to the nozzle outlet 50 of slightly larger cross-section than the outlet from tip 46, and is provided with a ring of air inlet apertures 52 around the tip 46 upstream of its end. Cap 48 thus defines a venturi passage in which the flow of water from the tip 46 to outlet 50 produces substantial negative pressure at the apertures 52, causing air to flow therethrough into the stream, thereby aerating it. Fitting 34 has an attachment flange 54 like flanges 44 for attachment to a corresponding flange on standpipe 36 so that the axis of sections 34 is angularly adjustable about the axis of standpipe 36.

FIGS. 6 and 7 show nozzle pairs of an alternative form, which may be preferable for capacities which would require an outlet 50 in the FIGS. 4 and 5 embodiment in excess of 4 inches in diameter. In FIGS. 6 and 7, the pipe sections 56 are the same as sections 32 of previous Figures and have corresponding end closure plates 58 and attachment flanges 60 for adjustable attachment to corresponding flanges 62 on fitting 34. The nozzle pipes 64 of each pair differ from the nozzle pipes 38 of FIGS. 4 and 5 in that they are generally rectangular in internal and external cross-section with a greater length than width. Where air induction is utilized as contemplated in FIGS. 6 and 7, the nozzle pipes 64 are provided with a tip 66 (FIG. 7) slightly reduced in external and internal cross-section, about which are mounted caps 68 on spaced supports 70 secured to pipes 64 providing air inlet passages between them. Caps 68, except for their generally rectangular internal and external cross-sectional shape, are similar in form and function to the caps 48 of FIGS. 4 and 5, tapering from an enlarged section surrounding tip 66 to a nozzle outlet 72 of slightly greater internal dimensions than tip 66 and having its inner end spaced beyond tip 66 to permit air inflow. Air is inducted into the water through this space and between supports 70 by venturi action as in the FIGS. 4 and 5 embodiment. The resultant aeration of the water increases the cooling efficiency of the spray substantially. Our measurements have indicated that as much as one part by volume air to three parts by volume water can be obtained with the venturi arrangements as shown, and a ratio of at least one part air to four parts water is preferred. The flat stream ejected by the nozzles of FIGS. 6 and 7 provides a more uniform breaking of the stream into drops under the force of impingement of the two streams than would be the case with a generally circular cross-section stream of the same high volume.

It will be noted that pipes 64 are not only oppositely angled with respect to the axis of section 56 but also have their long axes at an acute angle to one another, as shown about 25°. The purpose of this is to enable the spray resulting from impingement of the streams to fan out more widely and evenly.

As an alternate to the elongate nozzle of FIGS. 6 and 7, it is possible to utilize a third nozzle of circular cross-section, with the three nozzles arranged at the points of a triangle so that their streams intersect at the same included angle along a common zone. The use of two nozzles is preferred, however, and the use of more than three nozzles with their streams mutually impinging is generally undesirable. As above noted, where more than two nozzles are used, it is important that the streams therefrom intersect each other along a common zone, since our tests have shown that if the spray from one or more nozzles additional to a first pair intersects the resultant spray from the pair, the effect is harmfully disruptive of the desired spray, including excessive backfall and formation of large oversize slugs of water, seriously impairing the cooling efficiency.

FIG. 8 shows a pair of nozzles according to FIGS. 6 and 7 mounted on a pipe section 74, which is a modification of pipe sections 32 and 56 of the previous Figures to the extent that it has two end flanges 76 and 78 by which it may be directly coupled into the piping 22 in cases where that is located at the stream surface or out of the stream, as in the modified arrangement of FIG. 10 hereinafter discussed. Flanges 76 and 78 are provided with bolt holes so that they may be attached to like flanges on in-line piping at various positions of the nozzles with respect to the axis of section 74. Round cross-section nozzles according to FIGS. 1–5 may also be mounted on sections such as 74.

With nozzles according to FIGS. 6–8, difficulty was experienced with excessive fall-back of water from the area of stream impingement at included angles of impingement above 40°. This problem was not encountered with the round cross-section nozzles, and placed an undesired restriction on the range of included angles that could be used. It was discovered that this difficulty could be resolved by the modification of FIG. 9 which enables this form of nozzle to be used without substantial water fall-back at included angls 50°–70° and higher, as is desirable.

Figure 9:
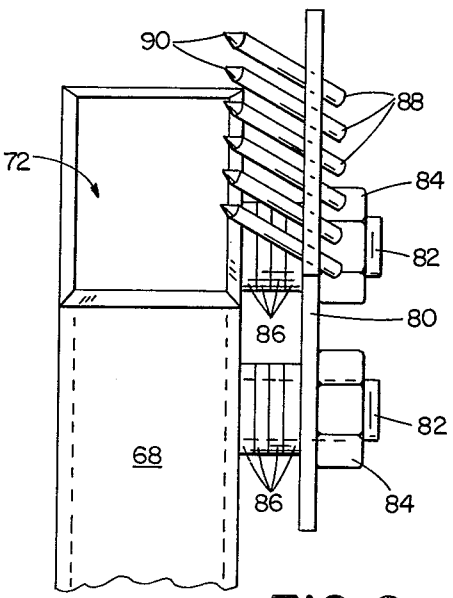
FIG. 9 is a fragmentary view in perspective of a modification of a nozzle according to FIG. 6.

Referring to FIG. 9, there is shown the outlet end of a nozzle cap 68 of a nozzle according to FIGS. 6–8, having outlet 72. The other nozzle of the pair (not shown) is assumed to be to the right in the Figure, so that the righthand face of the stream issuing from the nozzle shown impinges upon the stream from the other nozzle. A plate 80 is fastened to cap 68 below its outlet 72 by bolts 82 welded thereto and nuts 84 compressing the plate against spacers 86 surrounding bolts 82. A plurality of pins 88, six being shown, are secured to and extend through plate 80 so that they extend inwardly toward outlet 72 at an acute outward angle to the axis thereof, as shown about 30°. Pins 88 have beveled pointed tips 90 that extend into and indent the adjacent face of the stream issuing from outlet 72.

The indentation need not be great and in practice it has been found that extension of points 90 of pins 88 beyond the inner edge of outlet 72 about one-sixteenth inch is sufficient, with pins of a maximum diameter of about one-fourth inch. The indentation by the pins apparently produces corrugations in the face of the stream which persist until that face impinges on the face of the stream from the opposite nozzle, and the resultant irregularity is such as to enable the streams to meld into a resultant spray without significant backfall of water, which otherwise occurs above included angles of 40°. Use of the indenting pins on one nozzle of a pair has been found to be sufficient, although they may be used on both if desired.

Figure 10:
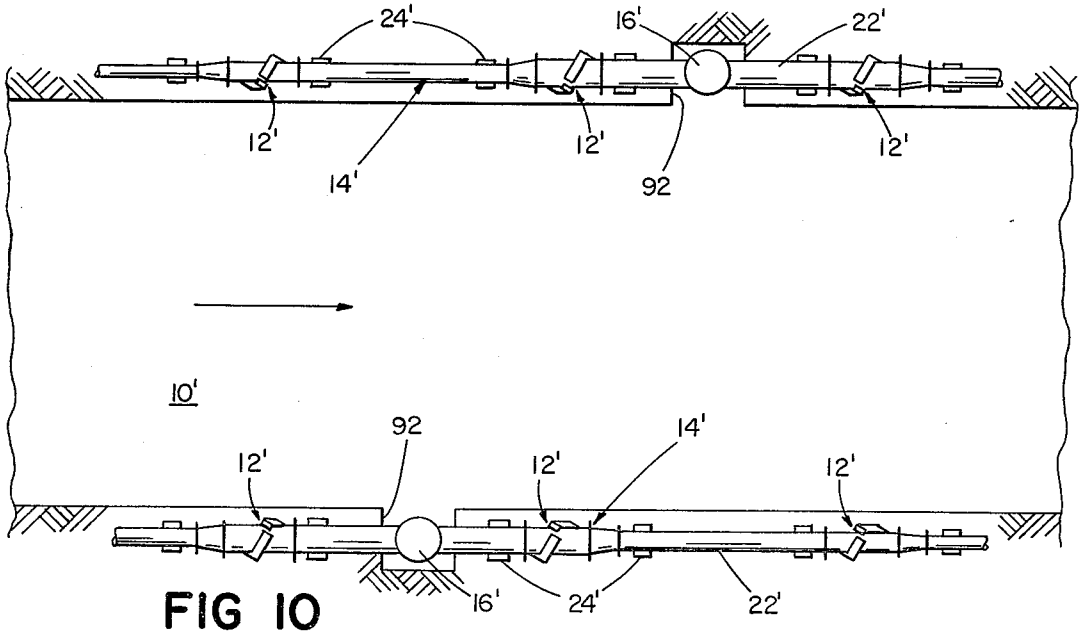
FIG. 10 is a fragmentary top plan view of a modification of FIG. 1.

FIG. 10 shows one of various possible alternative spray module arrangements to that shown in FIG. 1, primes of the same reference numerals being used to designate parts shown in previous Figures. In this instance the modules 14' are land based at the sides of the channel. Pumps 16' are mounted above sumps 92 open to the channel in which their impellers and housings (not shown) are located, with the impellers pumping the water up into piping 22' mounted on ground supports 24'. Nozzle pairs 12' are indicated as having the form of FIGS. 6–8 and are mounted on pipe sections 74' so that the sprays resultant from stream impact have a trajectory over and terminating in the channel receiver.

Land basing the modules as in FIG. 10 has substantial advantages from the standpoint of ease of installation and servicing. It should be noted that conical sprays of the prior art are not suitable for land basing, since the sprays must be directed toward only one side of a module. Where the channel is wide enough, the nozzle pairs may be opposite one another as shown and form sprays having a trajectory extending about half way across the channel. Alternatively, the nozzle pairs at one side of the channel may be disposed between those at the other side to form sprays with a trajectory extending nearly across the channel.

An alternative modular arrangement not shown includes modules similar to 14' of FIG. 10 but with two of the 74' pipe sections joined end to end at each nozzle location having their sprays directed to opposite sides of piping 22', which is supported at or above the surface of the stream on fixed or floating supports, with the pumps either land based or on fixed or floating supports in the stream.

The cross-sectional area of each nozzle can be as much as 20 square inches or even larger, with the preferred minimum cross-sectional area being about 4 square inches. While the drawings show the heated water pumped from a source which is also the receiver for the spray as is conventional, separate source and receiver may be provided, and the receiver need not be, although it usually is, a channel.

Figure 11:
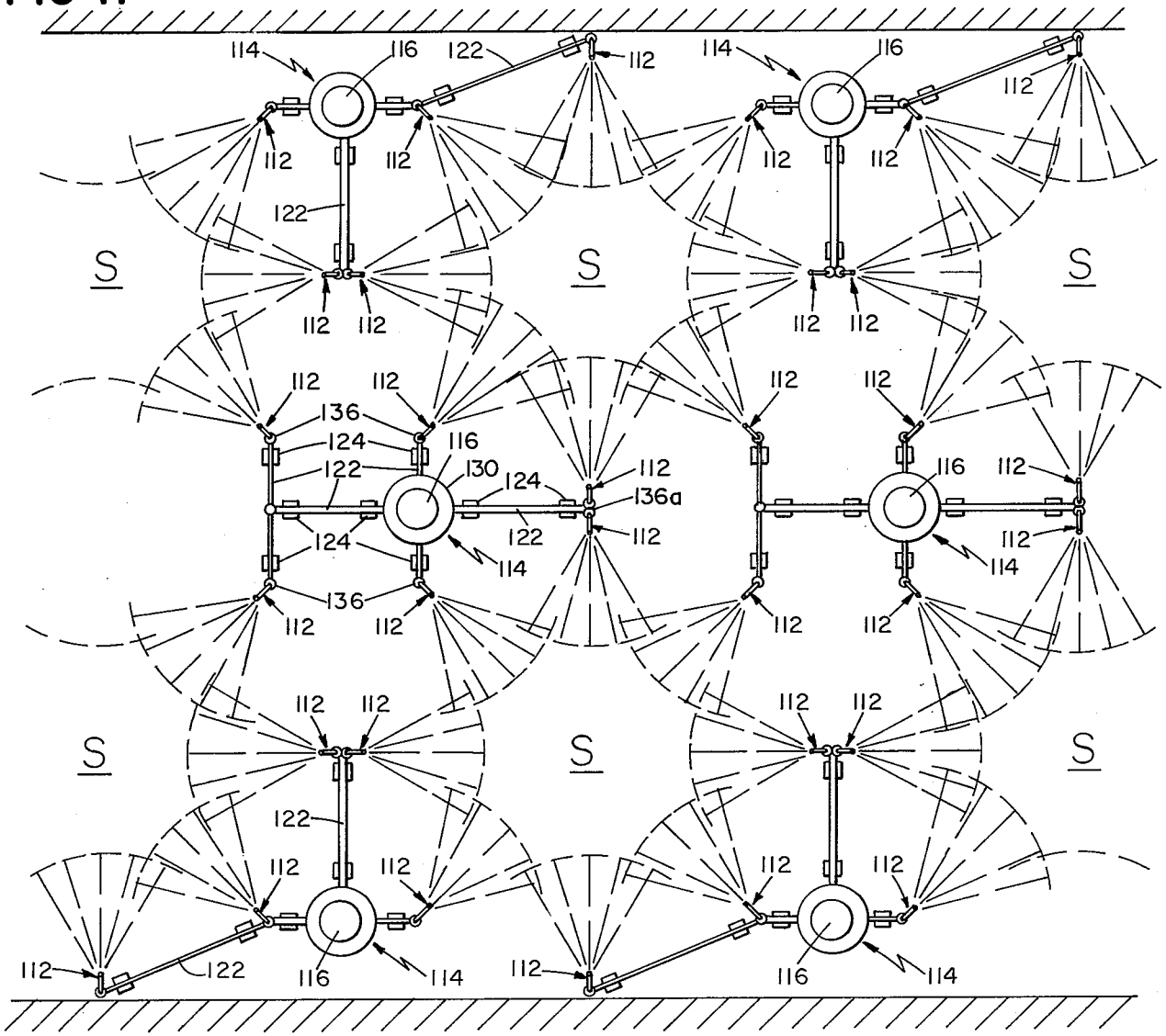
FIG. 11 is a view similar to FIG. 1 showing a different arrangement of nozzles.

FIG. 11 shows another modular arrangement designed to take advantage of the "chimney" effect of arranging the nozzle pairs in clusters from which the sprays discharge toward a common center. The receiver is indicated as a canal, although it may have other form such as a lagoon. The nozzle pairs designated generally 112, are arranged in modules, designated generally 114. Each module has a pump 116, surrounded by an anti-vortex plate 130, the construction and underwater support structure of which may be the same as in FIG. 1. The pump 116 of each module is connected to its nozzle pairs 112 by underwater piping 122 on supports 124 similar to pipes 22 and supports 24 of FIG. 1, and standpipes 136 like standpipes 36 of FIG. 1 except that each standpipe other than the one designated **136*a* has only one nozzle pair 112 connected to its top; whereas, standpipe 136*a*** has two such pairs. The modules at the center of the Figure have six nozzle pairs, while those at the sides have five.

The arrangement of modules is such that clusters of eight nozzle pairs on four different modules direct their sprays toward, but not to, the center of a common space S, which is sufficiently large so that only the corners of the sprays overlap. An arrangement of this type provides an air flow pattern very favorable to effective cooling, in that the sprays of each cluster induce a flow of fresh air therewith to the external periphery of the spaces S to displace the heated, moisture-laden air which rises in a central column as in a chimney, and is thus removed. The number and arrangement of nozzle pairs per module and per space S can obviously be widely varied while attaining a similar beneficial effect of such spray clustering.

The nozzle constructions shown in the Figures of the drawings previously discussed have the advantage of low construction cost, since they may be readily fabricated from commercially available components. However, friction losses inherent in the designs may increase horsepower costs and thus adversely affect overall efficiency to an undesirable extent. FIGS. 12–15 show a modified construction of nozzle pairs of round cross-section designed to minimize such losses and to increase overall efficiency to an extent more than justifying the cost of special forming, as by casting.

Figure 12:
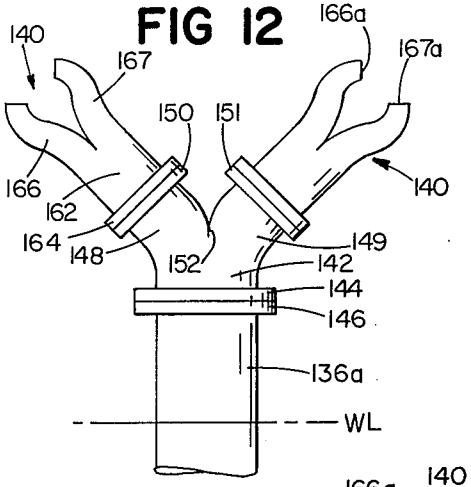
FIG. 12 is a side view of two nozzle pairs of another modified construction.
Figure 13:
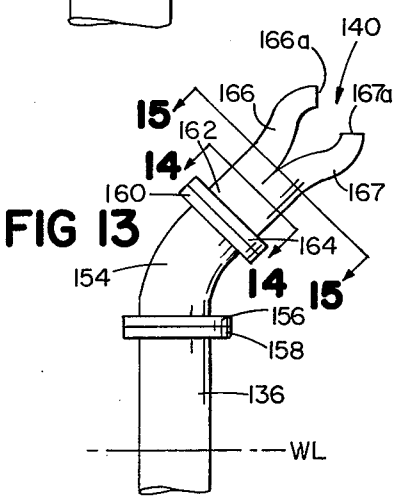
FIG. 13 is a view similar to FIG. 12 of a single nozzle pair of like construction.

FIG. 12 shows two of the modified nozzle pairs, and FIG. 13 shows a single pair, mounted, by way of illustration, on standpipes 136*a* and 136, respectively, of FIG. 11. The nozzle pairs, designated generally 140, are, in the case of FIG. 12, mounted to pipe 136*a* by a fitting having a circular cross-section base portion 142 of the same hollow interior diameter as pipe 136*a* and having an end flange 144 bolted to a matching flange 146 on the end of pipe 136*a*. Beyond portion 142 the fitting has two brances 148, 149, each of round cross-section and of the same reduced diameter to provide one-half the capacity of portion 142. Each branch 148 and 149 curves smoothly and gradually outwardly to an end flange 150 and 151 respectively. The flow from pipe 136*a* through fitting portion 142 splits evenly between the two branches at a sharp internal end juncture 152 thereof. The flow axes at flanges 150 and 151 through branches 148 and 149 are as desired for the nozzle pairs attached thereto.

In FIG. 13 the single nozzle pair 140 is mounted to standpipe 136 by an elbow pipe fitting 154 of circular cross-section and the same internal diameter as pipe 136. Fitting 154 has an end flange 156 bolted to a mating flange 158 on pipe 136, and a flange 160 at its opposite end. Fitting 154 curves smoothly and gradually to its exit end, where the flow axis is as desired for the nozzle pair attached thereto.

Figure 15:
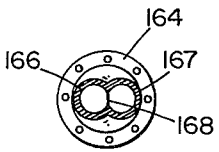
FIGS. 14 and 15 are cross-section views on lines 14—14 and 15—15, respectively, of FIG. 13, looking in the direction of the arrows.
Figure 14:
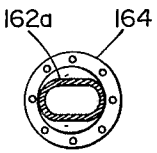

Each nozzle pair 140 has a hollow base portion 162 of circular cross section and of the same end diameter as the fitting branch or fitting to which it is connected, which has an end flange 164 matching end flanges 150, 151 and 160, to one of which it is bolted. From its flanged end, opposite walls of portion 162 are of progressively shortened radius to change the interior cross-section to essentially oval, or two flat sides with round ends, as seen in FIG. 14 at 162*a*. Beyond the section line 14—14 of FIG. 13, the central portions of the flat sides of the portion 162*a* are gradually oppositely curved inwardly to form two separate pipe portions 166 and 167 coaxial with the rounded ends of portion 162*a* and joining interiorly along a sharp edge 168, as seen in FIG. 15. Beyond the section line 15—15 in FIG. 13, pipe portions 166 and 167, which form the individual nozzles are gradually oppositely curved and slightly reduced in diameter to provide outlet ends 166*a* and 167*a* at the desired angle to one another.

It will be observed that with the nozzle pairs 140 and their fittings the flow has to make only the turn required by the angle of the nozzle pair to the axis of the pipe to which the pair is connected, and this is done about a gradual curve. The flow is axial into the nozzle pipes, with minor further flow curvature to the nozzle outlets. In comparison, the nozzle arrangements of earlier Figures require two right angle turns of the flow, one from the standpipe to the nozzle carrying pipe, and one from the latter pipe into the individual nozzle pipes. In addition, there is greater curvature of flow path in the individual nozzle pipes in these nozzle arrangements. The differences substantially favor the nozzles and fittings of FIGS. 12–15 in terms of reduced friction loses of pressure head. Their smooth transitions from single stream to two stream flow of reduced cross-section add to this advantage.

We claim:

1. In a system for cooling large quantities of heated water which includes piping connected to a plurality of spray forming means for discharging water therefrom as spaced sprays, pumping means for pumping heated water from a source thereof through said piping to said spray forming means, a receiver for collecting the sprayed water and an outlet for cooled water from said receiver;

the improvement wherein each said spray forming means consists of a plurality of associated nozzles connected to said piping, each associated nozzle having the capacity to discharge water therefrom at a flow rate of at least 500 gallons per minute in a coherent stream having a cross-sectional area of at least 2 square inches and a minimum cross-sectional dimension of one inch, and each associated nozzle arranged so that the stream ejected therefrom simultaneously impinges upon the stream ejected by each other nozzle associated therewith in a common zone beyond said nozzles before the stream has substantially dissociated with a force which breaks the streams into a spray of drops having a resultant arched trajectory proceeding away from said associated nozzles at an angle between vertical and horizontal and terminating in said receiver.

2. A system according to claim 1 wherein said common zone is spaced from 3 to 18 inches from the outlets of said associated nozzles.

3. A system according to claim 1 wherein each said spray forming means consists of two of said associated nozzles.

4. A system according to claim 1 wherein said cross-sectional area is at least 8 square inches.

5. A system according to claim 1 wherein the outlets of said nozzles are shaped to eject streams of substantially circular cross-section.

6. A system according to claim 5 wherein said included angle is in the range of about 60° to 70°.

7. A system according to claim 3 wherein the outlets of said nozzles are shaped to eject streams of substantially rectangular cross-section of greater length than width and are arranged so that the streams ejected therefrom impinge along their greater cross-sectional dimension.

8. A system according to claim 7 wherein said associated nozzles are oppositely tilted with respect to one another so that the streams ejected therefrom impinge with their greater cross-sectional dimensions at acute angles to one another.

9. A system according to claim 7 which includes means on the longer side of at least one of the associated nozzles of a pair for forming spaced indentations in the face of the stream issuing therefrom which first impinges on the stream issuing from the other associated nozzle.

10. A system according to claim 1 wherein each said spray forming means comprises a pipe section, said associated nozzles thereof are mounted on said pipe section with their inlet ends exposed to the interior of the pipe section and with their outlet ends exterior of the pipe section directed at opposite angles to its axis, and said pipe section is provided with an end flange for connection to a corresponding flange on said piping in selectively different angular positions of said nozzles about the axis of said pipe section.

11. A system according to claim 1 wherein the associated nozzles are integral end branch pipes of a base pipe and have inlet ends that communicate axially with said base pipe, said branch pipes being curved to provide outlet ends disposed at opposite angles to the axis of said base pipe, said base pipe having an end of larger diameter than said branch pipes adapted for connection to a supply pipe.

12. A system according to claim 11 wherein said base pipe is of circular cross-section at said end thereof, the cross-sectional area of said base pipe being progressively reduced toward the inlets of said branch pipes.

13. A system according to claim 11 wherein the cross-sectional shape of said base pipe progressively changes from single circular at said end thereof to two substantially circular portions joined along one said forming the inlets to said branch pipes.

14. A system according to claim 11 wherein said supply pipe is curved.

15. A system according to claim 1 which includes aerating means for aerating the water prior to ejection from said nozzles.

16. A system according to claim 15 wherein said aerating means comprises a venturi section provided in said nozzles having an inlet through which air is drawn into the water flowing through the venturi section.

17. A system according to claim 15 wherein said aerating means has the capacity to aerate said water with at least one volume of air to four volumes of water.

18. A system according to claim 1 wherein at least some of said spray forming means are arranged in one or more clusters, each cluster extending about a common space in said receiver so that the sprays therefrom are directed toward, but do not extend as far as, the central portion of said space.

19. A system according to claim 18 wherein the spray forming means of each said cluster thereof are arranged so that the sprays therefrom substantially surround said space.

* * * * *